US005229534A

United States Patent [19]

Suzuki

[11] Patent Number: 5,229,534

[45] Date of Patent: Jul. 20, 1993

[54] ENVELOPE GENERATING APPARATUS

[75] Inventor: Takashi Suzuki, Hamamatsu, Japan

[73] Assignee: Kabushiki Kaisha Kawai Gakki Seisakusho, Japan

[21] Appl. No.: 693,448

[22] Filed: Apr. 29, 1991

[30] Foreign Application Priority Data

May 10, 1990 [JP] Japan ..... 2-118767

[51] Int. Cl.[5] ..... G10D 00/00

[52] U.S. Cl. ..... 84/627; 84/663

[58] Field of Search ..... 84/626, 627, 663

[56] References Cited

U.S. PATENT DOCUMENTS

| | | | |
|---|---|---|---|
| Re. 30,906 | 4/1982 | Hiyoshi et al. | 84/627 |
| 4,135,424 | 1/1979 | Okamoto | 84/DIG. 23 |
| 4,178,826 | 12/1979 | Hiyoshi et al. | 84/627 |
| 4,185,532 | 1/1980 | Hiyoshi et al. | 364/722 |
| 4,373,416 | 2/1983 | Endo et al. | 84/604 |
| 4,909,120 | 3/1990 | Horiki et al. | 84/627 |

*Primary Examiner*—William M. Shoop, Jr.
*Assistant Examiner*—Brian Sircus
*Attorney, Agent, or Firm*—Bruce L. Adams; Van C. Wilks

[57] ABSTRACT

An envelope generating apparatus comprises a work memory, a buffer memory, an envelope generator, a writing circuit, and an end signal generator. The work memory stores parameters including a target level LV and an envelope speed parameter SP for generating an envelope signal of a predetermined phase. The buffer memory stores parameters including a target level LV and an envelope speed parameter SP for generating an envelope signal of a phase following the predetermined phase. The envelope generator generates an envelope signal based on the parameters stored in the work memory. When the envelope generator completes the generation of the envelope signal of a predetermined phase based on the parameters stored in the work memory, the writing circuit writes the content of the buffer memory into the work memory. When the envelope generator completes the generation of the envelope signal of a predetermined phase based on the parameters stored in the work memory, the end signal generator generates an end signal to request alteration of the content of the buffer memory. Every time the end signal requesting alteration of the content of the buffer memory is generated by the end signal generator, therefore, the content of the buffer memory is changed.

16 Claims, 7 Drawing Sheets

Fig. 3

| | BUFFER (B) | | WORK (W) | |
|---|---|---|---|---|
| 0ch | LV 0 | SP 0 | LV 0 | SP 0 |
| 1 | LV 1 | SP 1 | LV 1 | SP 1 |
| 2 | LV 2 | SP 2 | LV 2 | SP 2 |
| • | • | • | • | • |
| • | • | • | • | • |
| • | • | • | • | • |
| n-2 | LV N-2 | SP N-2 | LV N-2 | SP N-2 |
| n-1 | LV N-1 | SP N-1 | LV N-1 | SP N-1 |

Fig. 4

| |
|---|
| Σe DATA 0 ch |
| • |
| • |
| • |
| Σe DATA n-1 ch |

LV : TARGET LEVEL

SP : ENVELOPE SPEED PARAMETER

Σe : ENVELOPE ACCUMULATED VALUE (CURRENT VALUE DATA)

ENVELOPE GENERATING APPARATUS

BACKGROUND OF THE INVENTION

1. Field of the Invention

The present invention relates to an envelope generating apparatus of a musical tone generating apparatus used for a keyboard, an electronic piano, a synthesizer, etc. More specifically, the present invention pertains to an envelope generating apparatus which generates a complicated envelope.

2. Description of the Related Art

Conventionally, the dynamic level of a musical tone generated by an electronic musical instrument is realized by adding an envelope to tone wave data which is read from a wave memory.

In other words, a tone wave data signal read from the wave memory is multiplied by an envelope signal generated by an envelope generating apparatus to generate a tone signal of a predetermined timbre having a dynamic level.

In general, an envelope signal has multiple phases, such as attack, decay and release. The envelope generating apparatus, therefore, generates an envelope signal for each phase.

Two parameters are used to generate an envelope signal for each phase. One parameter is "target level LV" specifying a target value (level), and the other is "envelope speed parameter SP" specifying a time required for the level to reach the target value.

The envelope generating apparatus generates an envelope signal of a predetermined phase, for example, by repeating the following operation: the envelope generating apparatus holds the current value of an envelope to be generated, multiplies the envelope speed parameter SP by the difference between the target level LV and the current value, and adds the result to the current value.

To generate an envelope signal having three phases, attack, decay and release, parameters of the target level LV and envelope speed parameter SP should be prepared in advance, and when a request to generate the envelope signal made, the above-described operation should repeatedly be executed for the individual phases, attack, decay and release, using the prepared parameters.

The envelope signal generated in this manner is multiplied by tone wave data which is read from the wave memory, yielding an envelope-added musical tone.

The conventional envelope generating apparatus as described above, therefore, cannot generate a complicated envelope signal which has multiple phases.

SUMMARY OF THE INVENTION

The present invention has been developed to overcome the drawbacks of the prior art. In the prior art, the envelope is divided into three phases, attack, decay and release, in each of which parameters of the target level LV and the envelope speed parameter SP are stored. An envelope signal is generated using those parameters when an envelope-signal generating request is made, therefore a complicated envelope signal of multiple phases cannot be generated. It is therefore an object of the present invention to provide an envelope generating apparatus with a simple structure, which can generate a complicated envelope signal having multiple phases.

An envelope generating apparatus according to the present invention comprises:

first storage means for storing parameters to generate an envelope signal of a predetermined phase;

second storage means for storing parameters to generate an envelope signal of a phase following the predetermined phase;

envelope generating means for generating an envelope signal based on the parameters stored in the first storage means;

writing means for writing a content of the second storage means into the first storage means when the envelope generating means completes generation of the envelope signal of the predetermined phase based on the parameters stored in the first storage means; and end signal generating means for generating an end signal to request alteration of the content of the second storage means when the envelope generating means completes generation of the envelope signal of the predetermined phase based on the parameters stored in the first storage means.

According to the present invention, the envelope of a predetermined phase is generated based on parameters stored in the first storage means. Parameters stored in the second storage means are written into the first storage means after the generation of the envelope of the predetermined phase is completed, to prepare for the generation of an envelope of the next phase. Then, an end signal is generated by the end signal generating means to request for parameter writing, allowing the parameters of the next phase to be written in the second storage means. As a result, the envelope generating apparatus of the present invention has an uncomplicated structure and can remove the restriction on the variable number of phases and change it as needed, to thus provide for the generation of a complicated envelope.

BRIEF DESCRIPTION OF THE DRAWINGS

FIG. 3 is a diagram representing how parameters are stored in a parameter memory shown in FIG. 2;

FIG. 4 is a diagram showing how the current value $\Sigma e$ of the envelope value is stored in the envelope data memory shown in FIG. 2;

DETAILED DESCRIPTION OF THE PREFERRED EMBODIMENT

Figure 1:
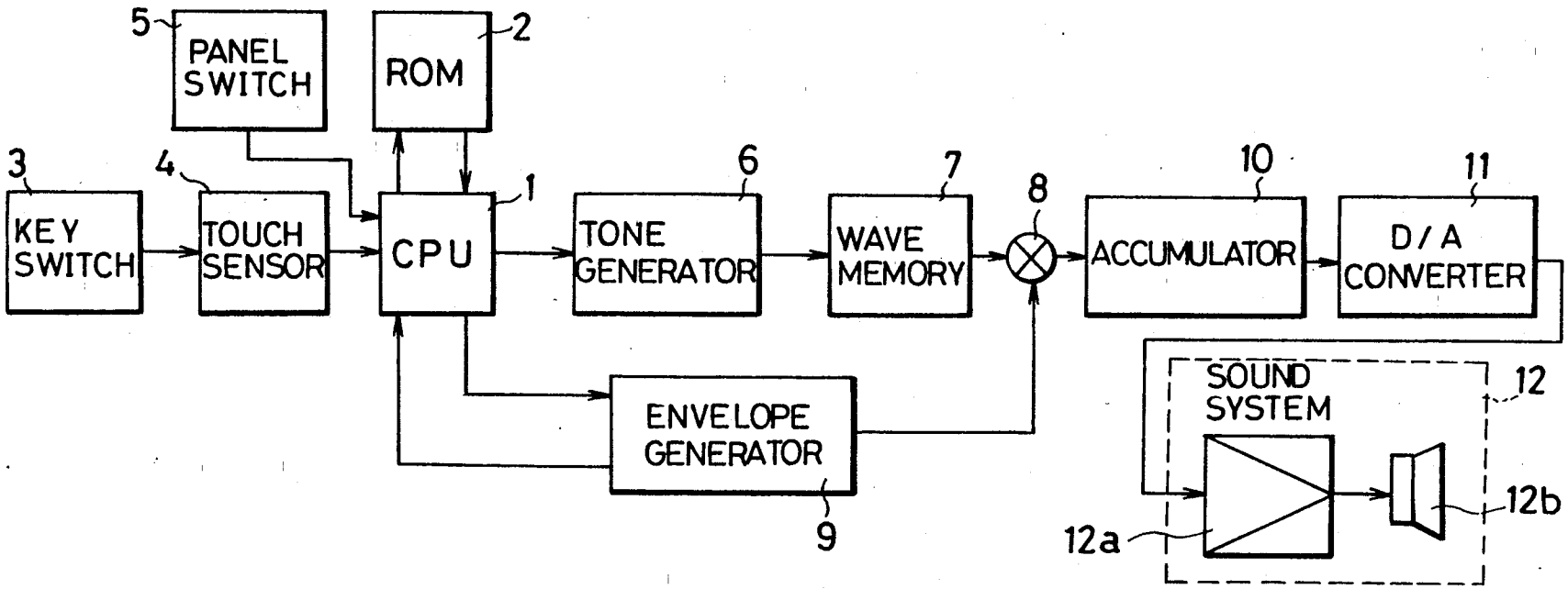
FIG. 1 is a block diagram illustrating the schematic structure of an electronic musical instrument to which an envelope generating apparatus according to the present invention is applied.

FIG. 1 is a block diagram illustrating the structure of an electronic musical instrument to which an envelope generating apparatus according to the present invention is applied.

A central processing unit (hereafter referred to as "CPU") 1 controls the individual sections of this electronic musical instrument. To realize the control, the CPU 1 sequentially reads a program stored in a program memory section in a read only memory (hereafter referred to as "ROM") 2, and interprets and runs it command by command.

The contents of the ROM 2 include not only a program to operate the CPU 1 but also timbre data, parameters (target level LV and envelope speed parameter SP) which are concerned with an envelope for each tone generating channel and directly relate to the feature of the present invention, and other various fixed data.

Key switches 3 are activated or deactivated interlockingly with individual keys on the keyboard which transmit the key depression or key release done by a player. An open/close signal of each switch is sent to a touch sensor 4.

The touch sensor 4 detects a key code indicating a depressed or released key and touch data representing the force of the key depression. This touch sensor 4 is well known as a touch detector. The key code and touch data detected by the touch sensor 4 are supplied to the CPU 1.

Panel switches 5 include a power switch, a mode designate switch, a timbre select switch, a rhythm select switch and various effect switches. A panel scanner (not shown) detects how these switches 5 are set. The status of each switch is detected by the panel scanner and are each encoded and supplied as a panel switch code to the CPU 1.

A tone generator 6 executes various types of control to generate a tone signal. For example, the tone generator 6 generates an address which is supplied to a wave memory 7 to read wave data from the memory 7. The wave data corresponds to a timbre selected by the timbre select switch of the panel switches 5 and the key code of the depressed or released key among the key switches 3.

The wave memory 7 stores multiple pieces of wave data corresponding to a timbre or a pitch. The wave memory 7 receives data output from the tone generator 6 as an address, and outputs one piece of wave data from the addressed location. The wave data, which is sequentially read from the wave memory 7, is sent as a digital tone wave signal to a multiplier 8.

An envelope generator 9 generates an envelope signal for controlling the amplitude of a tone wave signal, in accordance with parameters sent through the CPU 1. The envelope signal generated by the envelope generator 9 is also supplied to the multiplier 8. This envelope generator 9 will be described in detail later.

The multiplier 8 multiplies a digital tone wave signal from the wave memory 7 by an envelope signal from the envelope generator 9, generating a digital tone signal with an envelope added, i.e., a tone signal with a controlled dynamic level. The envelope-added digital tone signal by the multiplier 8 is sent to an accumulator 10.

An accumulator 10 accumulates the sequentially generated digital tone signals from the multiplier 8 to synthesize the accumulated signals as one digital tone signal. This signal from the accumulator 10 is applied to a D/A converter 11.

The D/A converter 11 converts a digital tone signal from the accumulator 10 into an analog tone signal, and supplies it to a sound system 12.

The sound system 12, comprising an amplifier **12*a* and a loudspeaker or a headphone 12*b*, converts the analog tone signal, received as an electronic signal from the D/A converter 11**, into an acoustic signal and generates a corresponding musical tone.

Figure 2:
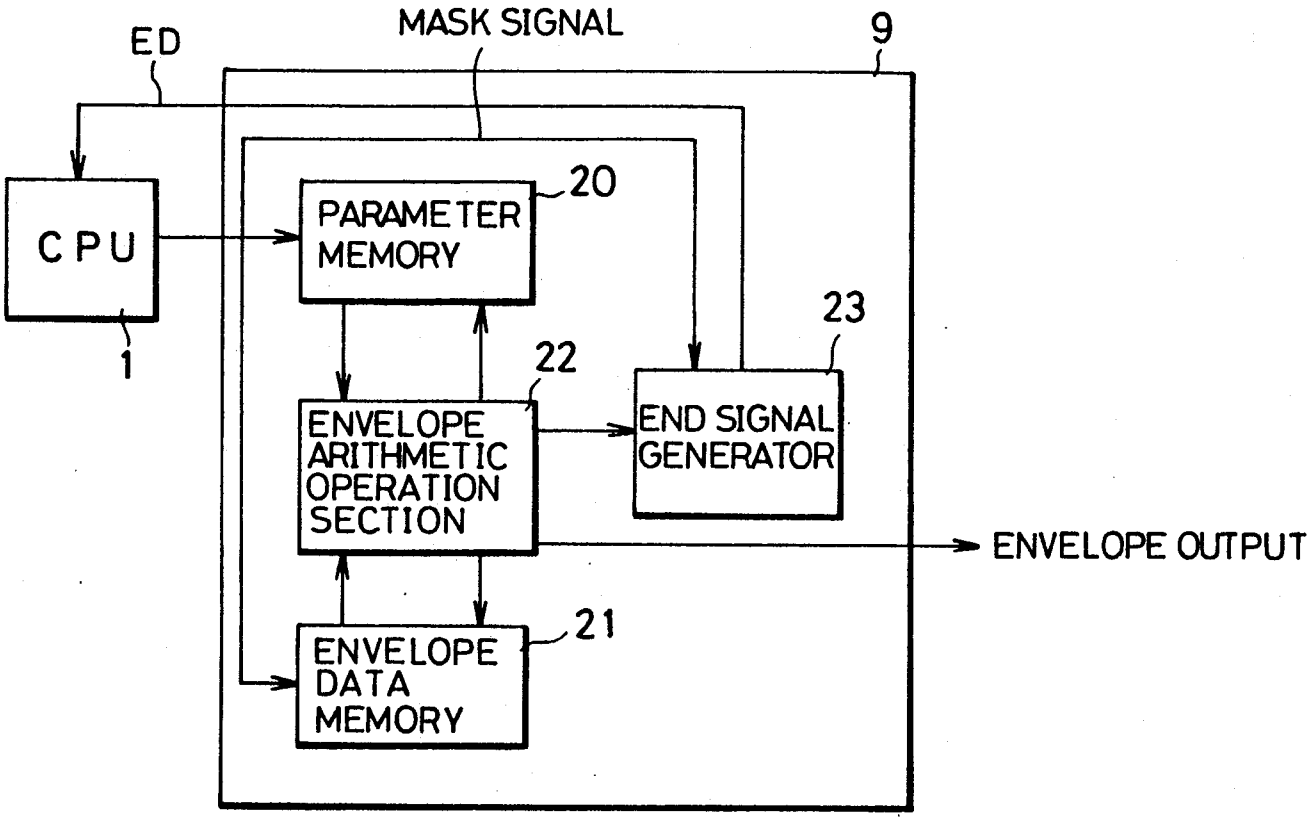
FIG. 2 is a block diagram illustrating the structure of the envelope generator according to one embodiment of the present invention.

FIG. 2 is a block diagram illustrating the detailed structure of the envelope generator 9 shown in FIG. 1.

The envelope generator 9 includes a parameter memory 20, an envelope data memory 21, an envelope arithmetic operation section 22 and an end signal generator 23.

The parameter memory 20 stores parameters for envelope generation, including a target level LV and envelope speed parameter SP, in a manner shown in FIG. 3, for example. The parameter memory 20 has a buffer area (B) and a work area (W) where two sets of parameters are to be respectively stored for each of n tone generating channels 0ch to n−1ch.

The envelope data memory 21 stores a current envelope value (envelope accumulated value), Σe, in the manner as shown in FIG. 4, for example. The envelope data memory 21 stores the current envelope value Σe for each of n tone generating channels 0ch to n−1ch.

Figure 5:
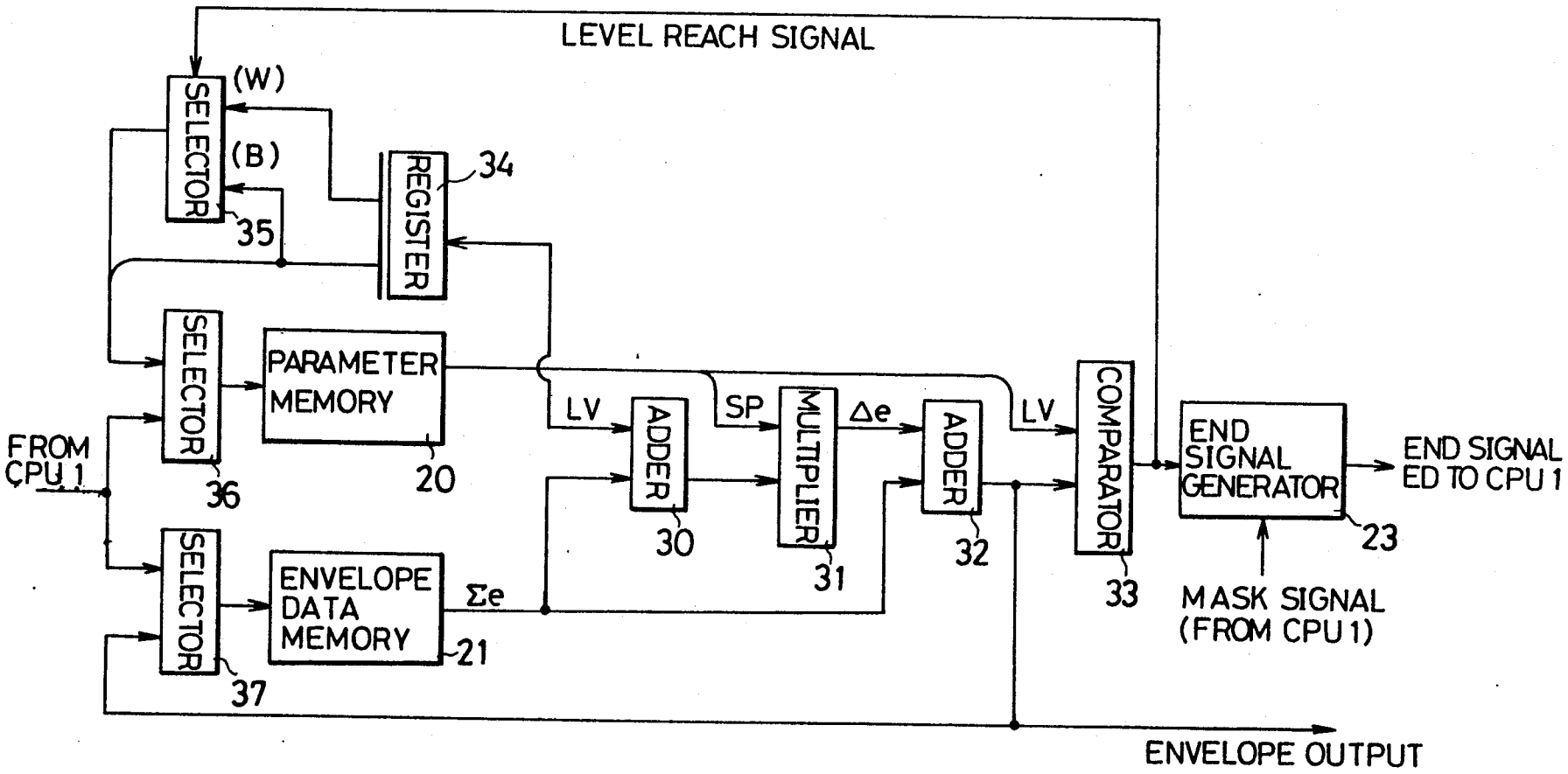
FIG. 5 is a block diagram illustrating the detailed structure of the envelope generator according to the embodiment of the present invention.

FIG. 5 is a block diagram illustrating the detailed structure of the envelope generator 9, with particular emphasis on the envelope arithmetic operation section 22.

An adder 30 performs an arithmetic operation (subtraction) on the outputs of the parameter memory 20 and the envelope data memory 21. The output of the parameter memory 20 is the target level LV stored in the work area (W), while the output of the envelope data memory 21 is the current envelope value Σe The adder 30 sends its output to a multiplier 31.

The multiplier 31 multiplies the output of the adder 30 by the output of the parameter memory 20, i.e., the envelope speed parameter SP stored in the work area (W). The multiplier 31 supplies its output Δe to an adder 32.

The adder 32 performs an arithmetic operation (subtraction) on the output Δe of the multiplier 31 and the output of the envelope data memory 21, i.e., the current envelope value Σe. The output of the adder 32 is sent as an envelope output signal to the multiplier 8 (see FIG. 1). The adder 32 also supplies its output to a comparator 33 and a selector 37.

The comparator 33 compares the output of the adder 32 with that of the parameter memory 20, which is the target level LV stored in the work area (W). When the current value Σe has reached the target level LV, the comparator 33 sends a level reach signal to an end signal generator 23.

A register 34 holds the target level LV and envelope speed parameter SP stored in the buffer area (B) of the parameter memory 20, and the target level LV and envelope speed parameter SP stored in the work area (W). The contents of the register 34 are supplied to selectors 35 and 36.

In response to the level reach signal from the comparator 33, the selector 35 selects, from the contents of the register 34, a set of the target level LV and the envelope speed parameter SP stored either in the buffer area (B) or in the work area (W). The output of the selector 35 is linked to the target level LV and the envelope speed parameter SP stored in the buffer area (B) of the register 34 and the result is supplied to the selector 36.

The selector 36 selects data to be written into the parameter memory 20, i.e., selects either data from the CPU 1 or data such that the outputs of the register 34 and the selector 35 are linked together. The selector 36 applies its output to the parameter memory 20.

The selector 37 selects data to be written into the envelope data memory 21, i.e., it selects either data from the CPU 1 or data from the adder 32. The selector 37 supplies its output to the envelope data memory 21.

The end signal generator 23 receives the level reach signal from the comparator 33 in the envelope arithmetic operation section 22, and generates an end signal ED to be sent to the CPU 1.

A mask circuit (not shown), provided in the end signal generator 23, inhibits the generation of the end signal ED by a mask signal which is sent from the CPU 1. Masking or unmasking the end signal ED is specified when the CPU 1 writes a parameter into the parameter memory 20. In generating an envelope signal of a decay phase, for example, since the parameter need not be rewritten even when the envelope signal has reached the target level, the mask circuit is used to mask the end signal ED to inhibit the CPU 1 from being informed of the end of the operation.

Figure 6:
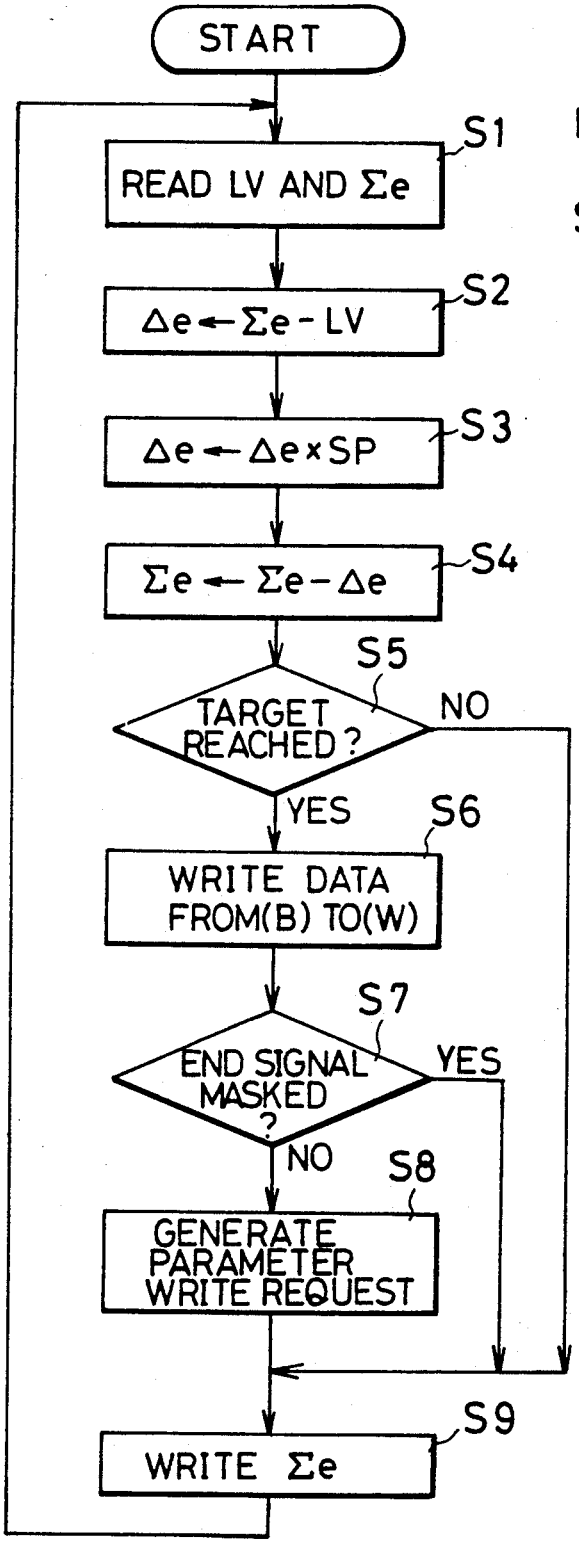
FIG. 6 is a flowchart for explaining the operation of the embodiment according to the present invention.

The operation of the envelope generator 9 with the above-described structure will now be described referring to the flowchart in FIG. 6.

When a player operates keys, the associated key switch 3 is rendered ON or OFF. The ON/OFF status of the key switch 3 is detected by the touch sensor 4, and is sent as a key code and touch data to the CPU 1. Upon reception of the key code and touch data, the CPU 1 starts a tone generating process.

In other words, the CPU 1 reads timbre data from the ROM 2, corresponding to the data which is selected by the panel switch 5, and supplies the data to the tone generator 6. The CPU 1 also sends a frequency number (data specifying a speed of reading data from the wave memory 7) corresponding to the received key code, to the tone generator 6.

The tone generator 6 generates an address of the wave memory 7 where wave data corresponding to the timbre data is stored, and sends the address to the wave memory 7 at a speed (interval) according to the frequency numbers. Accordingly, the wave data of timbre to be generated is sequentially read from the wave memory 7 at a speed according to the key code, and is supplied to the multiplier 8.

While the wave data is being read, the CPU 1 reads from the ROM 2 parameters (the target level LV and the envelope speed parameter SP) for a channel from which musical tones should be generated, and writes the parameters into the parameter memory 20 of the envelope generator 9. In other words, the selector 36 is controlled to pass the data from the CPU 1 therethrough. The data passing the selector 36 is supplied to the parameter memory 20 so that the associated parameters are written therein. At this time, the first-phase parameters of the envelope to be generated are written into the work area (W) of the parameter memory 20, while the parameters for the next phase are written in the buffer area (B).

Further, the CPU 1 initializes the current value Σe in a channel region in the envelope data memory 21 from which musical tones should be generated. In other words, the selector 37 is controlled to pass data from the CPU 1. Such data is sent to the envelope data memory 21 and the initial value is written into the memory 21.

Masking of the end signal generator 23, upon reception of an unmask signal from the CPU 1, is released, and the generator 23 is enabled to generate the end signal ED accordingly. When the above-described operation is completed, the envelope generator 9 starts its operation.

A target level LV is read from an associated channel region in the work area (W) of the parameter memory 20, and is supplied to one input terminal of the adder 30. At the same time, a current value Σe is read from the associated channel region in the envelope data memory 21 and is sent to the other input terminal of the adder 30 (step S1). The adder 30 performs an arithmetic operation as follows, providing a difference value Δe (step S2).

$$\Delta e \Sigma e - LV \tag{1}$$

Then, the multiplier 31 multiplies the envelope speed parameter SP, which has been read from the associated channel region in the work area (W) of the parameter memory 20, by the difference value Δe as expressed by the formula (2), thus yielding a new difference value Δe (step S3).

$$\Delta e \leftarrow \Delta e \times SP \tag{2}$$

Further, the adder 32 adds the current value Σe for the associated channel, which has been read out previously in step S1, to the output Δe of the multiplier 31 as represented by the formula (3), thereby updating the current value Σe (envelope accumulated value) (step S4).

$$\Sigma e \leftarrow \Sigma e - \Delta e \tag{3}$$

This renewed current value Σe, i.e., the envelope accumulated value, is provided as an envelope output to the multiplier 8 (see FIG. 1). At this time, if $\Delta e > 0$, it indicates the decreasing direction, and if $\Delta e < 0$, it indicates the increasing direction.

The comparator 33 compares the target level LV, read out in step S1, with the renewed current value Σe output from the adder 32 to judge whether the current value Σe has reached the target level (step S5). Unless the comparator 33 renders the level reach signal active, the current value Σe has not yet reached the target level LV, so that the renewed current value Σe will be written into the associated channel region of the envelope data memory 21 (step S9).

When the comparator 33 renders the level reach signal active in step S5, which means the current value Σe has reached the target level LV, the envelope generation for one phase is considered to have been terminated, and the content of the buffer area (B) of the parameter memory 20 is written into the work area (W) (step S6).

In other words, as the output of the comparator 33 is supplied to the select terminal of the selector 35, the selector 35 is controlled to pass the target level LV and envelope speed parameter SP in the buffer area (B), which are stored in the register 34. At this time, the register 34 is holding the contents of the buffer area (B) and work area (W) currently in use. Therefore, as data writing is executed under the above selecting condition, the old content of the buffer area (B) is written in the buffer area (B) and the work area (W) for the associated channel region. This features realizes a function to move the content of the buffer area (B) into the work area (W).

When the above operation is completed, the envelope generator 9 starts computing an envelope for the next target level LV using new parameters, and outputs an envelope of the next phase.

The output of the comparator 33 is supplied to the end signal generator 23 which in turn determines whether or not to generate the end signal ED to the CPU 1. First, it is judged whether or not generation of the end signal ED is masked (step S7). When it is determined that no masking is done, the end signal generator 23 generates the end signal ED, and outputs a parameter write request to the CPU 1 (step S8). Upon reception of this end signal ED, the CPU 1 writes new parameters into the buffer area (B) in the parameter memory 20 to be ready for generation of an envelope of the next phase.

Then, the updated current value Σe is written in the associated channel region in the envelope data memory 21 in the same manner as described earlier (step S9). The updated current value Σe becomes the initial value of the envelope of the next phase. The flow then returns to step S1 and the generation of the envelope signal continues in the above-described sequence of processes.

If it is determined in step S7 that the end signal has been masked, the flow jumps to step S9 where the updated current value Σe is written in the associated channel region in the envelope data memory 21 as previously described. The flow then returns to step S1 to resume the generation of the envelope signal in the above-described sequence of processes. In this case, since the end signal ED, i.e., the parameter write request, is not generated from the end signal generator 23, the content of the buffer area (B) in the parameter memory 20 will not be changed and is held intact. Therefore, the envelope generation continues with the same parameters thereafter until the masking is released. The envelope generation under the masking condition is used in the case where the same status needs to be maintained, such as generation of an envelope of a decay phase.

The envelope signal thus generated is multiplied by wave data read out from the wave memory 7, yielding an envelope-added digital tone signal. This envelope-added digital tone signal is accumulated in the accumulator 10 and is then sent to the D/A converter 11. The D/A converter 11 converts the received digital tone signal into an analog signal which is in turn supplied to the sound system 12. The sound system 12 generates a sound corresponding to the analog signal.

Figure 7:
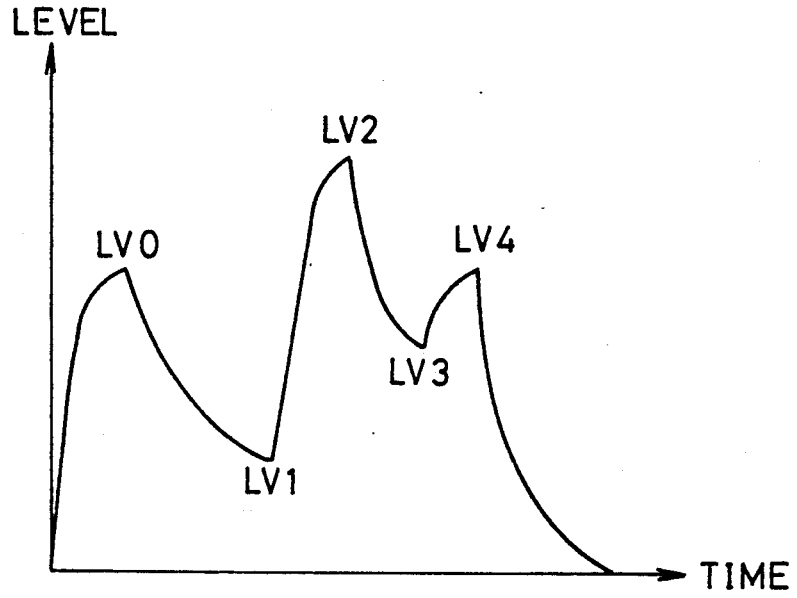
FIG. 7 is a diagram exemplifying an envelope generated according to the embodiment of the present invention.

As described above, according to this embodiment, an envelope of a predetermined phase is generated on the basis of the target level LV and envelope speed parameter SP stored as parameters in the work area (W) in the parameter memory 20, and when the generation of the envelope of the predetermined phase is completed, the target level LV and envelope speed parameter SP stored as parameters in the buffer area (B) in the parameter memory 20 are written in the work area (W) to be ready for generation of an envelope of the next phase. At this time, the end signal generator 23 generates the end signal ED, requesting parameter writing, so that the parameters for the next phase are further written in the buffer area (B). Accordingly, even with a simple structure, the envelope generating apparatus according to this embodiment can change the number of phases, eliminating the conventional restriction thereon, and can generate a complicated envelope with an arbitrary shape as shown in, for example, FIG. 7, without considering the phases, such as attack, decay and release, which typically constitute an envelope.

In the case where an envelope in the same status continues as for the decay phase, the end signal ED from the end signal generator 23 is masked and the envelope is generated while maintaining the content of the parameter memory 20. This reduces the burden on the CPU 1 so that the CPU 1 can be allotted to other processing, thus ensuring execution of faster and various types of processing.

Unlike the prior art, it is unnecessary to provide parameters for each phase in the parameter memory, presenting an effect of reducing the capacity of the parameter memory.

Although the parameters are stored in advance in the ROM 2, if parameters are provided for each tone generating channel, the number of phases can be changed for each tone generating channel. If the content of the work area (W) is directly changed by the CPU 1, an envelope can be curved before the current value Σe of the envelope reaches the target value. This arrangement can increase the freedom in adding an envelope to a tone signal.

Although the CPU 1 is supplied with the end signal ED and determines whether or not processing for a predetermined phase has been completed in accordance with this end signal ED, it is better to supply the end signal ED as an interrupt signal to the CPU 1. This structure can relieve the CPU 1 of always monitoring the end signal ED and can permit the CPU 1 to perform other processing as much as possible, thus improving the processing efficiency.

Figure 8:
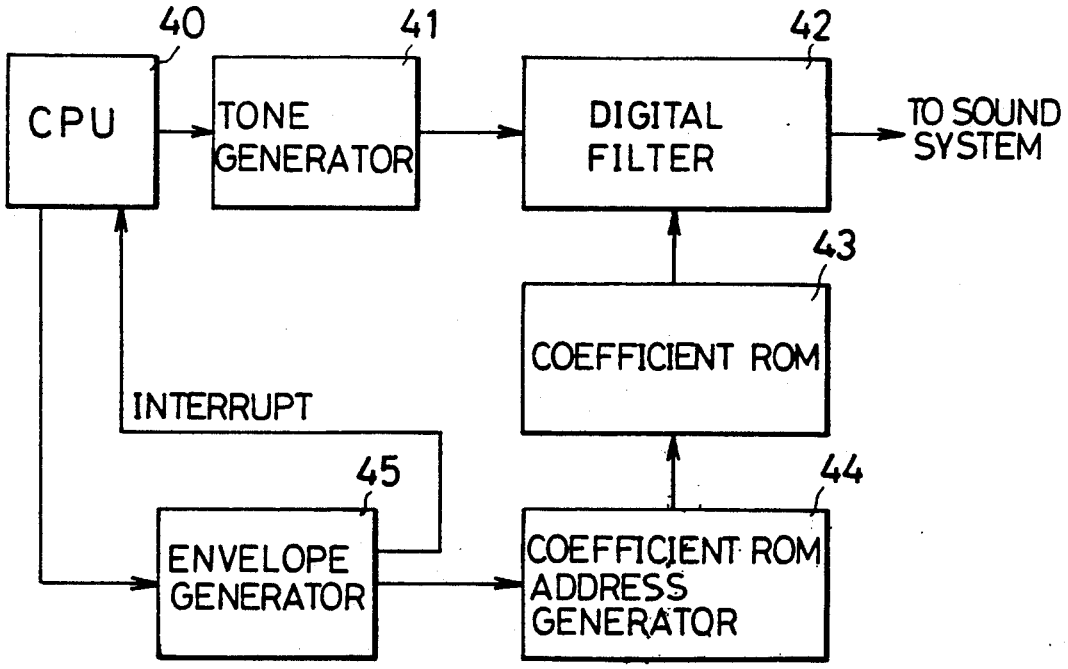
FIG. 8 is a diagram exemplifying the application of the envelope generating apparatus of the present invention to the cutoff control of a digital filter.
Figure 9:
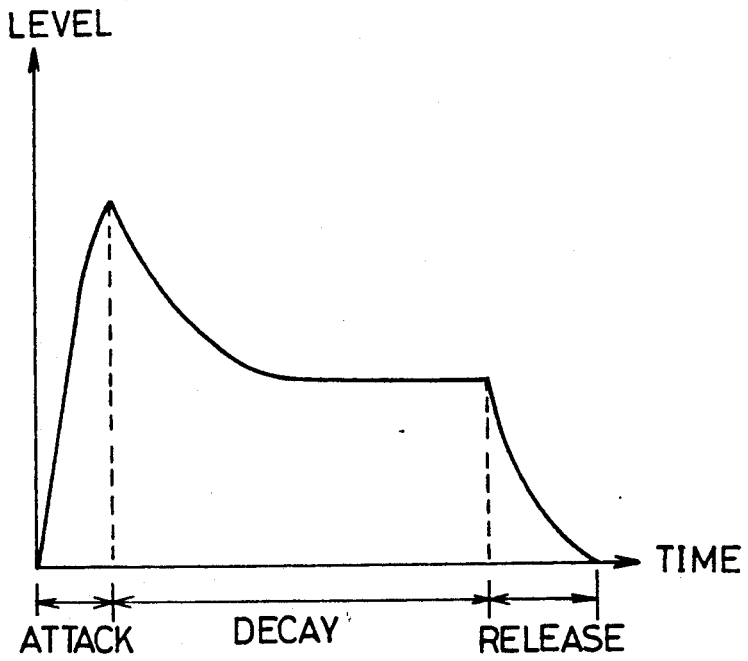
FIG. 9 is a diagram for explaining a typical envelope.

FIG. 8 exemplifies the application of the envelope generating apparatus of the present invention to the cutoff control of a digital filter.

A tone signal generated from a tone generator 41 under the control of a CPU 40 is filtered by a digital filter 42 before it is supplied to a sound system for sound release.

A filter coefficient for the digital filter 42 is supplied from a coefficient ROM 43. Address information for selecting the filter coefficient in the coefficient ROM 43 is generated by a coefficient ROM address generator 44, which is supplied with a predetermined signal from an envelope generator 45.

The envelope generator 45 has substantially the same structure as the above-described envelope generator 9, so that its description will be omitted. The envelope generator 45 assigns a target cutoff value as data equivalent to the target level LV used in the abovedescribed embodiment, and step data as data equivalent to the aforementioned envelope speed parameter SP. The envelope generator 45 generates a signal with an arbitrary shape in the same operation as described earlier.

The signal generated from the envelope generator 45 is supplied to the coefficient ROM address generator 44. This address generator 44 in turn generates an address based on which the associated filter coefficient is read out from the coefficient ROM 43. This proper filter coefficient is then supplied to the digital filter 42, so that a musical tone having a timbre or the like changing with the lapse of time can be obtained.

The envelope generating apparatus of the present invention with the same function and operation as described above may also be used as an arbitrary function generating apparatus.

As described above, the present invention can provide an envelope generating apparatus which is capable of generating a complicated envelope signal having multiple phases even with a simple structure.

What is claimed is:

1. A tone generating apparatus having a CPU, a ROM directly accessible by said CPU and for storing multiple sets of envelope parameters, each of said multiple sets of envelope parameters including parameters for at least attack, decay and release phases, and an envelope generator, the envelope generator comprising:

first storing means for storing one set of envelope parameters for only one phase to generate an envelope signal of a predetermined phase;

second storing means for storing one set of envelope parameters for only one phase to generate an envelope signal of a phase following said predetermined phase;

envelope generating means for generating an envelope signal based on said one set of envelope parameters stored in said first storing means;

level reach signal generating means for generating a level reach signal when said envelope signal of said predetermined phase generated by said envelope generating means has reached a target value of said one set of envelope parameters stored in said first storing means;

writing means for writing a content of said second storing means into said first storing means based on said level reach signal; and end signal generating means for generating an end signal to request alteration of said content of said second storing means to a new one set of envelope parameters read from said ROM based on said level reach signal, and sending said end signal to said CPU.

2. An envelope generating apparatus according to claim 1, wherein said parameters stored in said first storing means include a target level for defining the target value and an envelope speed parameter for defining a time to reach said target value.

3. An envelope generating apparatus according to claim 1, wherein said first storing means stores said parameters for tone generating channels.

4. An envelope generating apparatus according to claim 1, wherein said parameters stored in said second storing means include a target level for defining the target value and an envelope speed parameter for defining a time to reach said target value.

5. An envelope generating apparatus according to claim 1, wherein said second storing means stores said parameters for tone generating channels.

6. A tone generating apparatus having a CPU, a ROM directly accessible by said CPU and for storing multiple sets of envelope parameters, each of said multiple sets of envelope parameters including parameters for at least attack, decay and release phases, and an envelope generator, the envelope generator comprising:

first storing means for storing one set of envelope parameters for only one phase to generate an envelope signal of a predetermined phase;

second storing means for storing one set of envelope parameters for only one phase to generate an envelope signal of a phase following said predetermined phase;

envelope generating means for generating an envelope signal based on said one set of envelope parameters stored in said first storing means;

level reach signal generating means for generating a level reach signal when said envelope signal of said predetermined phase generated by said envelope generating means has reached a target value of said one set of envelope parameters stored in said first storing means;

writing means for writing a content of said second storing means into said first storing means based on said level reach signal;

end signal generating means for generating an end signal to request alteration of said content of said second storing means to a new one set of envelope parameters read from said ROM based on said level reach signal, and sending said end signal to said CPU; and masking means for masking said end signal generated by said end signal generating means.

7. An envelope generating apparatus according to claim 6, wherein said parameters stored in said first storing means include a target level for defining the target value and an envelope speed parameter for defining a time to reach said target value.

8. An envelope generating apparatus according to claim 6, wherein said first storing means stores said parameters for tone generating channels.

9. An envelope generating apparatus according to claim 6, wherein said parameters stored in said second storing means include a target level for defining the target value and an envelope speed parameter for defining a time to reach said target value.

10. An envelope generating apparatus according to claim 6, wherein said second storing means stores said parameters for tone generating channels.

11. A tone generating apparatus having a CPU, a ROM directly accessible by said CPU and for storing multiple sets of envelope parameters, each of said multiple sets of envelope parameters including parameters for at least attack, decay and release phases, and an envelope generator, the envelope generator comprising: first storing means for storing work parameters for only one phase for generating an envelope signal of a current phase; second storing means for storing buffer parameters for generating an envelope signal of a next phase following the current phase; envelope generating means receptive of the work parameters for only one phase for generating an envelope signal of the current phase dependent on the work parameters; means for generating a level reach signal when said envelope signal of the current phase generated by the envelope generating means has reached a target value of the work parameters for only one phase stored in the first storing means; writing means for writing the buffer parameters for only one phase from the second storing means into the first storing means based on the level reach signal, whereby the buffer parameters become the work parameters for the next phase; and end signal generating means for generating an end signal to enable alteration of the buffer parameters for only one phase stored in the second storing means to a new set of work parameters for only one phase from the ROM by the CPU based on the level reach signal.

12. An envelope generating apparatus according to claim 11; further comprising masking means for masking the end signal generated by the end signal generating means.

13. An envelope generating apparatus according to claim 11; wherein the first storing means stores work parameters for generating the current phase including a target level for defining the target value, and an envelope speed parameter for defining a time to reach the target value.

14. An envelope generating apparatus according to claim 11; wherein the first storing means stores work parameters for tone generating channels.

15. An envelope generating apparatus according to claim 11; wherein said second storing means stores buffer parameters for the next phase including a target level for defining the target value, and an envelope speed parameter for defining a time to reach the target value.

16. An envelope generating apparatus according to claim 11; wherein the second storing means stores buffer parameters for tone generating channels.

* * * * *